US006330878B1

(12) United States Patent
Perry et al.

(10) Patent No.: US 6,330,878 B1
(45) Date of Patent: Dec. 18, 2001

(54) EVAPORATIVE EMISSION LEAK DETECTION SYSTEM INCLUDING VACUUM REGULATOR WITH SENSITIVE SEAL

(75) Inventors: Paul D. Perry, Chatham; Ray Rasokas, Thamesville, both of (CA)

(73) Assignee: Siemens Canada Limited, Mississauga (CA)

( * ) Notice: Subject to any disclaimer, the term of this patent is extended or adjusted under 35 U.S.C. 154(b) by 0 days.

(21) Appl. No.: 09/583,634

(22) Filed: May 31, 2000

(51) Int. Cl.[7] ..... F02M 37/04

(52) U.S. Cl. ..... 123/519; 123/520; 137/497; 137/907

(58) Field of Search ..... 123/516, 518, 123/519, 520; 251/61.1, 359; 137/907, 494

(56) References Cited

U.S. PATENT DOCUMENTS

| | | | | |
|---|---|---|---|---|
| 2,986,159 | | 5/1961 | Snyder | 137/493 |
| 3,265,084 | | 8/1966 | Wagner | 137/508 |
| 3,468,511 | | 9/1969 | Haskins | 251/61.1 |
| 3,655,163 | | 4/1972 | Rattan et al. | 251/45 |
| 4,717,117 | | 1/1988 | Cook | 251/61.1 |
| 5,090,393 | * | 2/1992 | Holch | 137/907 |
| 5,146,902 | | 9/1992 | Cook et al. | 123/518 |
| 5,267,470 | | 12/1993 | Cook | 73/49.7 |
| 5,383,437 | | 1/1995 | Cook et al. | 123/520 |
| 5,429,099 | * | 7/1995 | Deland | 123/520 |
| 5,435,344 | | 7/1995 | Robinson et al. | 137/508 |
| 5,474,050 | | 12/1995 | Cook et al. | 123/520 |
| 5,509,444 | | 4/1996 | Robinson et al. | 137/508 |
| 5,749,349 | * | 5/1998 | Detweiler et al. | 123/520 |
| 5,853,018 | * | 12/1998 | Deland et al. | 123/518 |
| 6,016,690 | | 1/2000 | Cook et al. | 73/49.2 |
| 6,053,151 | * | 4/2000 | Cook et al. | 123/520 |
| 6,119,661 | * | 9/2000 | Deland et al. | 123/520 |

FOREIGN PATENT DOCUMENTS

| | | | |
|---|---|---|---|
| 59-54868 (A) | 3/1984 | (JP) | F16K/17/18 |

* cited by examiner

*Primary Examiner*—Thomas N. Moulis

(57) ABSTRACT

A module (22) for an on-board evaporative emission leak detection system that detects leakage from an evaporative emission space of a fuel system of an automotive vehicle. The module has a housing (50) that includes a first port (52) for communicating the housing to the evaporative emission space and a second port (86) for communicating the housing to atmosphere. The housing contains a particulate filter (84) through which the second port communicates with two parallel flow branches that extend within the housing to the first port. One branch contains a vacuum regulator valve (90), and the other, a solenoid-operated vent valve (88). During a leak detection test, the vent valve is operated closed, and a purge valve (20), that selectively communicates the evaporative emission space with the engine intake manifold, is operated open to cause vacuum to be drawn in the evaporative emission space. The vacuum regulator valve regulates evaporative emission space vacuum to a defined vacuum. At the beginning of the measurement phase of a test, the purge valve is operated closed. Leakage is evidenced by loss of vacuum, and a pressure sensor (110) signals vacuum loss. The regulator valve has a sensitive seal element (102) that assures integrity of regulator valve closure during the measurement phase.

36 Claims, 4 Drawing Sheets

EVAPORATIVE EMISSION LEAK DETECTION SYSTEM INCLUDING VACUUM REGULATOR WITH SENSITIVE SEAL

FIELD OF THE INVENTION

This invention relates to an on-board system for detecting fuel vapor leakage from an evaporative emission space of an automotive vehicle fuel system. It also relates to a system that utilizes vacuum drawn by the engine intake manifold for performing a leak test and to an improved regulator valve useful in such a system.

BACKGROUND OF THE INVENTION

A known on-board evaporative emission control system for an automotive vehicle comprises a vapor collection canister that collects volatile fuel vapors generated in the headspace of the fuel tank by the volatilization of liquid fuel in the tank and a purge valve for periodically purging those fuel vapors to an intake manifold of the engine. A known type of purge valve, sometimes called a canister purge solenoid (or CPS) valve, comprises a solenoid actuator that is under the control of a microprocessor-based engine management system, sometimes referred to by various names, such as an engine management computer or an engine electronic control unit.

During conditions conducive to purging, evaporative emission space that is cooperatively defined primarily by the tank headspace and the canister is purged to the engine intake manifold through the canister purge valve. A CPS-type valve is opened by a signal from the engine management computer in an amount that allows intake manifold vacuum to draw fuel vapors that are present in the tank headspace and/or stored in the canister for entrainment with combustible mixture passing into the engine's combustion chamber space at a rate consistent with engine operation so as to provide both acceptable vehicle driveability and an acceptable level of exhaust emissions.

Certain governmental regulations require that certain automotive vehicles powered by internal combustion engines which operate on volatile fuels such as gasoline, have evaporative emission control systems equipped with an on-board diagnostic capability for determining if a leak is present in the evaporative emission space. It has heretofore been proposed to make such a determination by temporarily creating a pressure condition in the evaporative emission space which is substantially different from the ambient atmospheric pressure, and then watching for a change in that substantially different pressure which is indicative of a leak.

It is believed fair to say that there are two basic types of diagnostic systems and methods for determining integrity of an evaporative emission space against leakage.

Commonly owned U.S. Pat. No. 5,146,902 "Positive Pressure Canister Purge System Integrity Confirmation" discloses one type: namely, a system and method for making a leakage determination by pressurizing the evaporative emission space to a certain positive pressure therein (the word "positive" meaning relative to ambient atmospheric pressure) and then watching for a drop in positive pressure indicative of a leak. Other positive pressure type systems are disclosed in commonly owned U.S. Pat. Nos. 5,383,437; and 5,474,050.

The other of the two general types of systems for making a leakage determination does so by creating in the evaporative emission space, a certain negative pressure (the word "negative" meaning relative to ambient atmospheric pressure so as to denote vacuum) and then watching for a loss of vacuum indicative of a leak. A known procedure employed by this latter type of system in connection with a diagnostic test comprises utilizing engine manifold vacuum to create vacuum in the evaporative emission space. Because that space may, at certain non-test times, be vented through the canister to allow vapors to be efficiently purged when the CPS valve is opened for purging fuel vapors from the tank headspace and canister, it is known to communicate the canister vent port to atmosphere through a vent valve that is open when vapors are being purged to the engine, but that closes preparatory to a diagnostic test so that a desired test vacuum can be drawn in the evaporative emission space for the test. Once a desired vacuum has been drawn, the purge valve is closed, and leakage appears as a loss of vacuum during the length of the test time after the purge valve has been operated closed.

In order for an engine management computer to ascertain when a desired vacuum has been drawn so that it can command the purge valve to close, and for loss of vacuum to thereafter be detected, it is known to employ an electric sensor, or transducer, that measures negative pressure, i.e. vacuum, in the evaporative emission space by supplying a measurement signal to the engine management computer. It is known to mount such a sensor on the vehicle's fuel tank where it will be exposed to the tank headspace. For example, commonly owned U.S. Pat. No. 5,267,470 discloses a pressure sensor mounting in conjunction with a fuel tank roll-over valve.

Further improvements in leak detection systems that utilize vacuum for a test are disclosed in commonly owned allowed U.S. patent application Nos. 09/036,128 and 09/036,129 which disclose a module associated with an evaporative emission system and comprising a vacuum regulator that limits the vacuum that can be drawn in the evaporative emission space to a predetermined maximum during a test. The module comprises a housing having a first port adapted to be communicated to atmosphere and a second port adapted to be placed in communication with the evaporative emission space. Two flow branches extend in parallel between the first and second ports. One branch comprises a selectively operable vent valve for opening and closing the one branch. The other branch comprises a regulator valve for regulating pressure differential between the first and second ports to a defined differential when the vent valve is closed and the differential attempts to increase beyond the defined differential. The regulator valve is provided within the housing and comprises a movable wall dividing a first chamber space from a second chamber space. The first chamber space communicates via the first port to atmosphere, and the second port communicates the second chamber space to the evaporative emission space. The valve comprises relatively positionable first and second parts, the first part being movable with the movable wall relative to the second part to open and close a flow path through the movable wall between the first and second chamber spaces. A spring biases the two parts toward closure of the flow path, and the spring and the two chamber spaces having a relationship that causes the flow path to be closed when pressure differential between the two chamber spaces is less than a predetermined differential, and that causes the flow path to be open when the pressure differential between the two chamber spaces is greater than the predetermined differential.

During the preparatory phase of a leak test before the actual test measurement begins, the purge valve is open and the engine is running to draw suitable vacuum in the evaporative emission space. The regulator valve functions to regulate the vacuum being drawn in the evaporative emission space to the set point of the regulator. The vacuum drawn is allowed to stabilize before the purge valve is closed and the test measurement begins. During the measurement phase any leakage through the regulator valve will appear as leakage from the space being tested. Accordingly, it is desirable to assure that no such leakage through the regulator valve occurs.

SUMMARY OF THE INVENTION

One aspect of the present invention relates to an improvement that accomplishes the objective of avoiding leakage through the vacuum regulator valve during the measurement phase of a leak test. This is accomplished by a suitable seal, described herein.

One aspect of the invention relates to an automotive vehicle comprising a fuel-consuming internal combustion engine that powers the vehicle and comprises an intake manifold, a fuel storage system that stores volatile liquid fuel for consumption by the engine and comprises an evaporative emission space for containing fuel vapor, and an evaporative emission control system comprising a vent valve for selectively opening and closing a vent path from the evaporative emission space to atmosphere, a fuel vapor collection medium disposed in the vent path for trapping fuel vapors so their escape to atmosphere through the vent path is prevented, and a purge valve for selectively opening and closing a vapor purge path from the evaporative emission space to the intake manifold to selectively purge fuel vapors from the evaporative emission space and medium to the engine. A vacuum regulator valve is effective during a leak test to regulate vacuum in the evaporative emission space to a defined magnitude when the vent valve is closed, the purge valve is open, and the engine is running. The vacuum regulator valve comprises a movable wall dividing a housing into a first chamber space communicated to atmosphere and a second chamber space communicated to the evaporative emission space. A spring resiliently biases the movable wall in a sense toward decreasing the volume of the first chamber space while increasing the volume of the second chamber space. The movable wall has a through-hole via which the two spaces can communicate. A compliant, impermeable seal element toward which the movable wall is resiliently biased comprises a face disposed to confront the movable wall for selectively sealing against the movable wall around the margin of the through-hole to close the through-hole and unsealing from the margin of the through-hole to open the through-hole.

A further aspect relates to an evaporative emission control system having such a vent valve and regulator valve.

A further aspect relates to a leak detection module having such a vent valve and regulator valve.

A further aspect relates to the regulator valve.

The foregoing, and other features, along with various advantages and benefits of the invention, will be seen in the ensuing description and claims which are accompanied by drawings. The drawings, which are incorporated herein and constitute part of this specification, disclose a preferred embodiment of the invention according to the best mode contemplated at this time for carrying out the invention.

DESCRIPTION OF THE PREFERRED EMBODIMENTS

Figure 1:
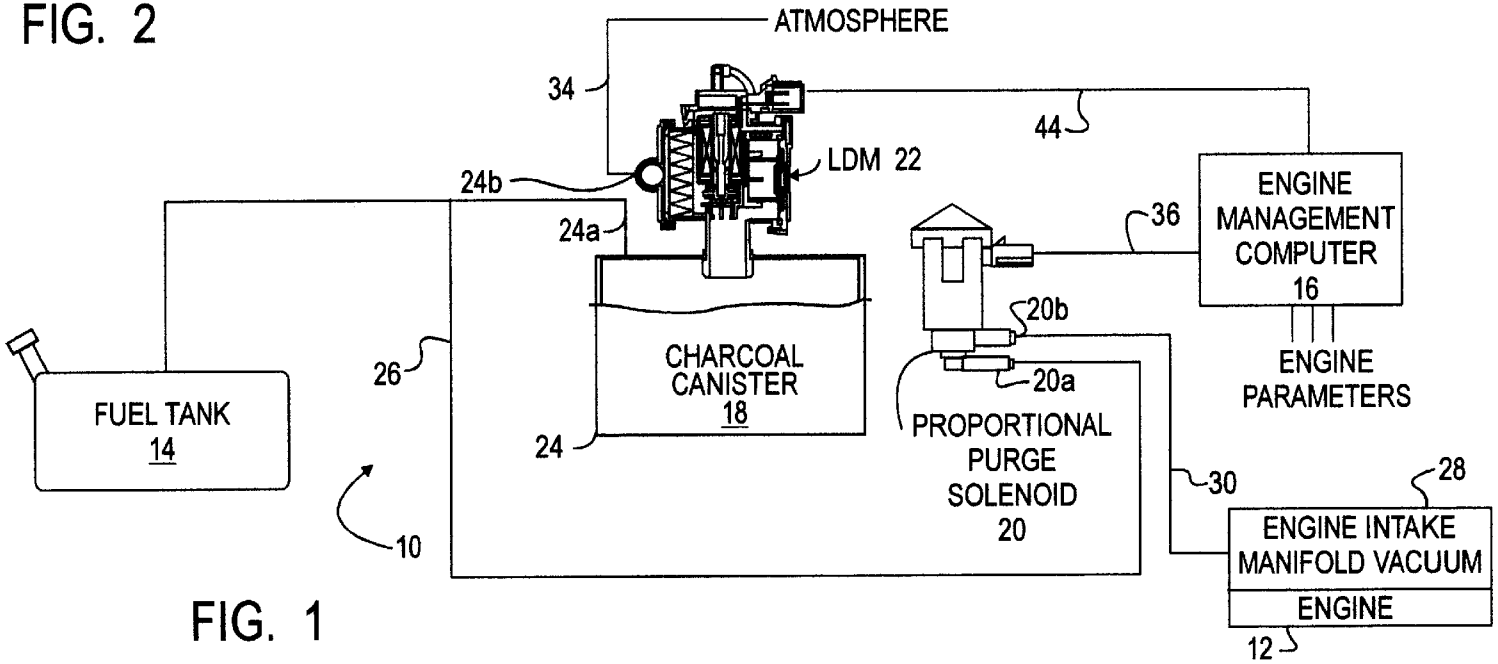
FIG. 1 is a general schematic diagram of an automotive vehicle evaporative emission control system including a leak detection system and leak detection module embodying principles of the invention.

FIG. 1 shows an automotive vehicle evaporative emission control (EEC) system 10 in association with an internal combustion engine 12 that powers the vehicle, a fuel tank 14 that holds a supply of volatile liquid fuel for the engine, and an engine management computer (EMC) 16 that exercises certain controls over operation of engine 12. EEC system 10 comprises a vapor collection canister (charcoal canister) 18, a proportional purge solenoid (PPS) valve 20, and a leak detection module (LDM) 22. In the illustrated embodiment, LDM 22 is shown mounted atop canister 18 so they form an integrated assembly, or module, 24.

Headspace of fuel tank 14, a port 24*a* of module 24, and an inlet port 20*a* of PPS valve 20 are placed in common fluid communication by a conduit 26 so that the tank headspace and the canister cooperatively define evaporative emission space within which fuel vapors generated by volatilization of fuel in tank 14 are temporarily confined and collected until purged to an intake manifold 28 of engine 12. Another conduit 30 fluid-connects an outlet port 20*b* of PPS valve 20 with intake manifold 28. Another conduit 34 fluid-connects a port 24*b* of module 24 to atmosphere.

EMC 16 receives a number of inputs (engine-related parameters for example) relevant to control of certain operations of engine 12 and its associated systems, including EEC system 10. One electrical output port of EMC 16 controls PPS valve 20 via an electrical connection 36; other ports of EMC 16 are coupled with module 24 via electrical connections, depicted generally by the reference numeral 44 in FIG. 1.

From time to time, EMC 16 commands LDM 22 to perform a leak detection test for ascertaining the integrity of EEC system 10, particularly the evaporative emission space that contains volatile fuel vapors, against leakage. During such test times, EMC 16 commands PPS valve 20 to open condition to enable manifold vacuum to be drawn in the evaporative emission space being tested. At times of engine running other than during such test times, EMC 16 operates PPS valve 20 to purge vapors from the evaporative emission space, including vapor adsorbent medium in canister 18, in a scheduled manner, but without creating vacuum magnitudes in the evaporative emission space that are comparable to those drawn during a test. LDM 22 is operated by EMC 16 according to whether testing is being conducted.

EMC 16 selectively operates PPS valve 20 during non-test times such that the valve opens under conditions conducive to purging and closes under conditions not conducive to purging. During those times LDM 22 assumes a condition of providing relatively unrestricted venting of the evaporative emission space to atmosphere. Thus, during times of operation of the automotive vehicle, the canister purge function is performed in a known manner for the particular vehicle and engine so long as a leak detection test is not being performed. When a leak detection test is commenced, EMC 16 operates PPS valve 20 open to communicate the evaporative emission space to intake manifold vacuum, and it causes LDM 22 to close the normally unrestricted vent to atmosphere. Consequently, vacuum begins to be drawn in the evaporative emission space, accompanied by fuel vapor purging. LDM 22 further includes a vacuum regulator valve that is effective during a test to regulate evaporative emission space vacuum to a predetermined magnitude, and once that vacuum has been attained and achieves substantial stability, a leakage determination can be made.

Figure 2:
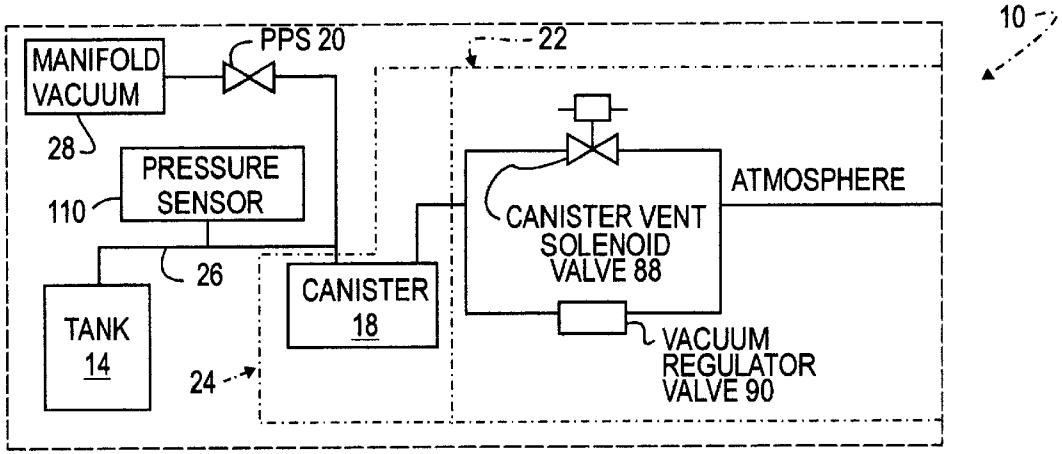
FIG. 2 is a more detailed schematic diagram of certain portions of FIG. 1.

FIG. 2 schematically depicts LDM 22 in conjunction with components already described. Structural detail of LDM 22 is presented in FIGS. 3–8. The latter six show LDM 22 to comprise a main body, or housing, 50, preferably fabricated from suitable fuel-resistant plastic. Main body 50, per se, comprises a walled structure having several openings into its interior. One opening comprises an integral nipple 52 forming a port through which main body 50 can be placed in fluid communication with the interior of canister 18. Another opening opposite nipple 52 is closed by a sensor cap assembly 54. A third opening in a side wall of main body 50 is closed by a filter cap 56. A fourth opening opposite the third is closed by a regulator cap 58.

Figure 3:
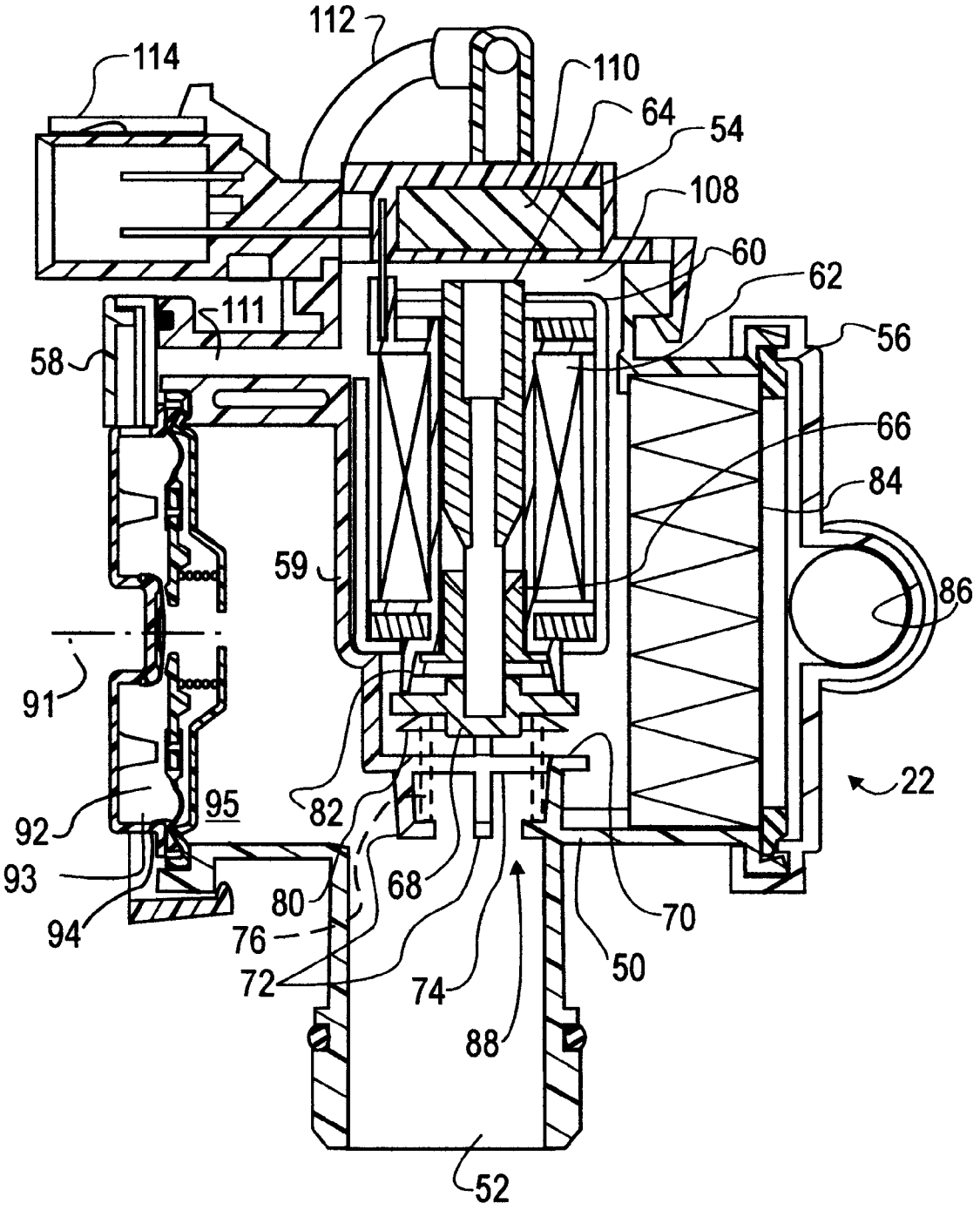
FIG. 3 is an elevation view, in cross section, through an exemplary canister-mounted leak detection module adapted for mounting on a vapor collection canister of an evaporative emission control system.
Figure 6:
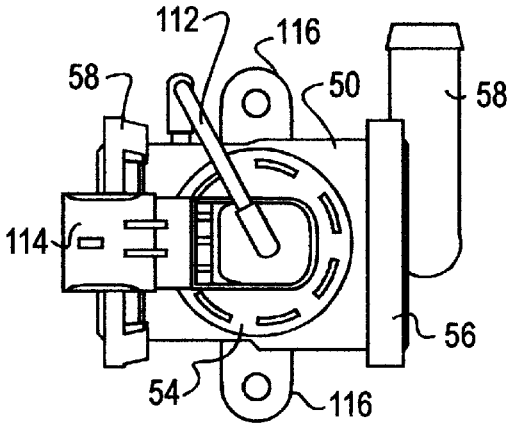
FIG. 6 is a full top view of FIG. 3, on a reduced scale.
Figure 4:
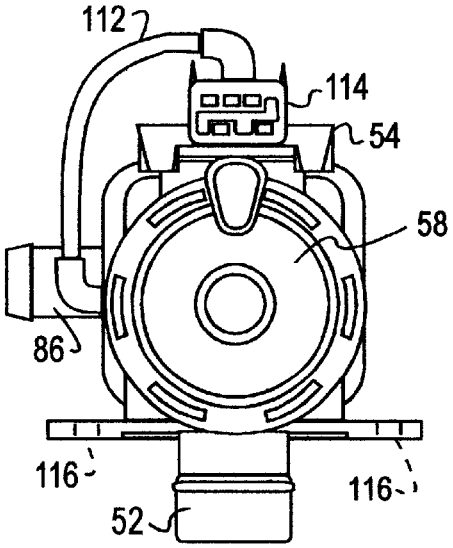
FIG. 4 is a full left side elevation view of FIG. 3, on a reduced scale.
Figure 5:
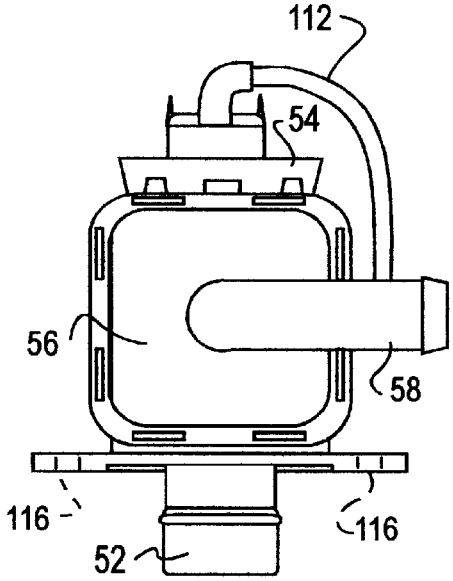
FIG. 5 is a full right side elevation view of FIG. 3, on a reduced scale.

The interior of main body 50 comprises a walled receptacle 59 containing a solenoid assembly 60. Solenoid assembly 60 is assembled into receptacle 59 through the opening that is subsequently closed by sensor cap assembly 54. Solenoid assembly 60 comprises a bobbin-mounted electromagnetic coil 62 and an associated stator structure composed of several ferromagnetic parts to form a portion of the solenoid's magnetic circuit. A cylindrical ferromagnetic armature 64 cooperates with this stator structure to complete the magnetic circuit via air gaps between the stator structure and the armature. Armature 64 is arranged coaxial with a main axis of the solenoid and is guided for straight line motion along that axis within the bobbin that contains coil 62. As shown by FIG. 3, the confronting, complementary tapered, axial ends of armature 64 and a stator part 66 are separated by an air gap of the magnetic circuit.

A non-ferromagnetic valve element 68 has a head and a cylindrical stem for attachment to armature 64. Receptacle 59 comprises an integral valve seat 70, including several formations 72 disposed around a central through-hole 74 therein which provide a seat for seating one end of a helical coiled compression spring 76. The other end of spring 76 is centered on the face of the head of valve element 68, fitting over a boss formed in the valve head face. The valve head contains an annular one-piece lip seal 80. Spring 76 continuously biases the valve head away from seat 70 and toward a stop 82 so that the through-hole 74 is normally open. Thus, solenoid assembly 60 and valve seat 70 form a normally open solenoid-operated valve within main body 50.

The opening in main body 50 that is closed by filter cap 56 encloses a particulate filter element 84 within the main body. Filter element 84 is in filtering relation to a nipple 86 forming a port that extends from filter cap 56 as an integral formation thereof and that corresponds to port 24*b*. Interior of main body 50, filter element 84 faces a side of receptacle 59. The receptacle wall contains an opening that places the filter element in fluid communication with valve seat 70 on the interior end of through-hole 74. Hence, when seal 80 is not seated on seat 70, the valve is open, allowing substantially unrestricted flow through filter element 84 between nipples 86 and 52. When seal 80 seats on the seat closing the valve, that flow path is closed. The solenoid-operated valve may therefore be identified as a canister vent solenoid valve (CVS valve), shown schematically at 88 in FIG. 2 as one portion of LDM 22.

Figure 7:
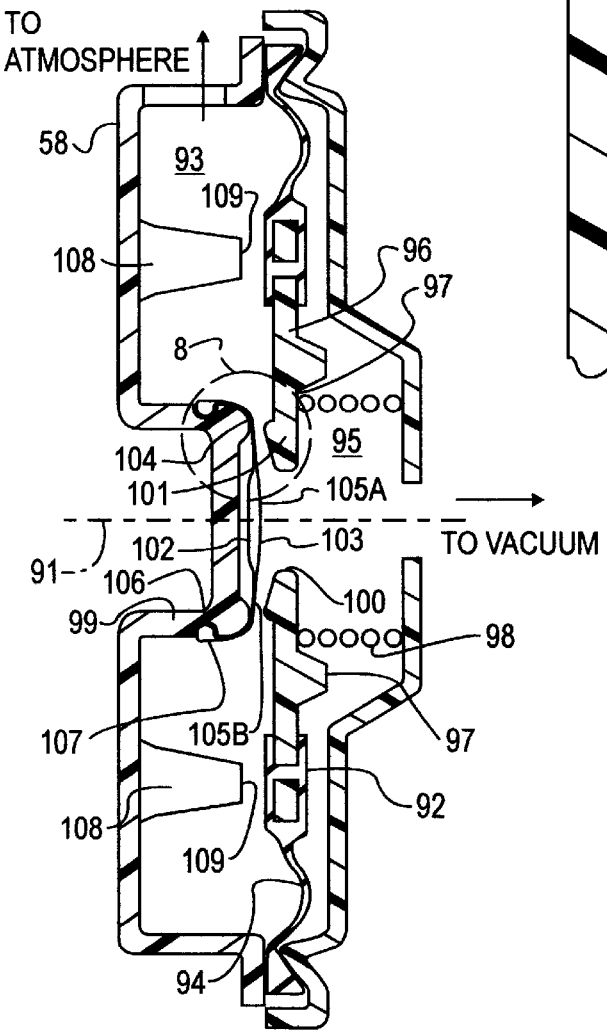
FIG. 7 is an enlarged view of a portion of FIG. 3.

FIG. 2 shows LDM 22 to also comprise a vacuum regulator valve 90 in parallel flow relation with CVS valve 88. FIGS. 3 and 7 show that vacuum regulator valve 90 has an imaginary center line 91 and comprises a movable wall 92 arranged concentric with and transverse to that center line. Movable wall 92 is in covering relation to the opening in main body 50 that is closed by regulator cap 58, and serves to separate a first interior chamber space 93 from a second interior chamber space 95 within main body 50. FIG. 3 shows chamber space 95 to be continuously open to nipple 52, and chamber space 93 to be continuously open to nipple 86 through filter element 84 via an internal passage 111 that includes a hole through the margin of a part 94 aligned with an end of a hole in main body 50. Part 94 is generally annular, containing a flexible convolution, and it forms a radially outer portion of movable wall 92. The otherwise open center of part 94 is closed by a rigid, circular annular insert 96 to complete movable wall 92. Part 94 may be insert-molded to insert 96 to create a leak-proof joint joining the inner margin of the former and the outer margin of the latter.

Insert 96 comprises an inner face that contains an annular shoulder 97 surrounding a through-hole 100 at the center to form a spring seat for one axial end of a helical coil compression spring 98. The opposite axial end of spring 98 seats within a formation on a side of receptacle 59 opposite filter element 84. Spring 98 is thereby constrained to continuously urge the central region of movable wall 92 axially in a direction toward regulator cap 58, a direction that tends to decrease the volume of chamber space 93 while increasing that of chamber space 95.

At its center, the wall of regulator cap 58 is formed to comprise a circular cylindrical post 99 that is coaxial with center line 91 and with the center of insert 96. On the face of insert 96 that is toward post 99, the margin of through-hole 100 is shaped to provide a lip 101 that is slightly concave in cross section radial to center line 91 and that generally faces the end of post 99.

A seal element 102, that for convenience may be referred to as a sensitive seal, is disposed on, and in covering relation to, the end of post 99 that faces the center of insert 96. Element 102 is fabricated from a suitable compliant, but impermeable, material, such as fluorosilicone, and comprises a circular center face 103 that is supported on, and spans, a rounded circular annular rim 104 formed in post 99. Rim 104 protrudes from the end of post 99 toward insert 96 and extends continuously around the outer margin of the post end wall so that the rim supports a central zone 105 of face 103 in spaced relation to that portion of the post end wall circumscribed by the rim. Within central zone 105, face 103 is made thicker, reference numeral 105A, than in an adjoining annular region 105B that extends to the rim 104 and thence wraps around the crown of the rim where element 102 continues along the adjoining side of post 99. The side wall of post 99 contains a circular groove 106 that is spaced a short distance from rim 104. The terminus of element 102 comprises a bead 107 that seats in groove 106 in a manner that retains element 102 on post 99. When face 103 seals to lip 101, it is region 105B that makes surface-to-surface sealing contact with the concave face of lip 101.

Figure 8:
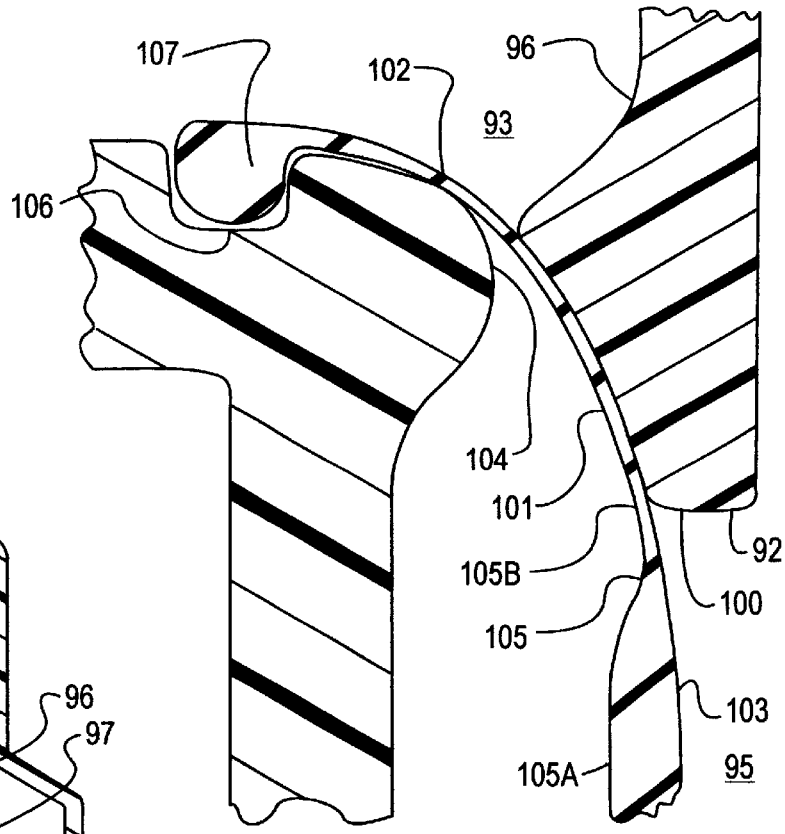
FIG. 8 is an enlarged view in circle 8 of FIG. 7.

Radially outward of post 99 relative to center line 91, the wall of cap 58 contains one or more formations 108 that protrude into the interior of chamber space 93. The free end surfaces of formations 108 define a stop plane 109 that is perpendicular to center line 91, and they are disposed to be abutted by movable wall 92 to limit the extent to which movable wall 92, especially insert 96, can be displaced toward cap 58. FIG. 8 shows the position of insert 96 relative to element 102 when the insert is maximally toward cap 58, being stopped by stop plane 109. The relationship is such that the center zone of insert 96, lip 101 in particular, is spaced from post 99, and in particular, is spaced from rim 104. During a leak test, the magnitude of vacuum to which chamber space 95 is being regulated by regulator valve 90 will create a net force acting on movable wall 92, that in conjunction with the force of spring 98, positions movable wall 92 from stop plane 109, but with lip 101 of insert 96 proximate face 103 of seal element 102. The area of movable wall 92 and the spring force versus compression characteristic define the set point of regulator valve 90.

Because vacuum is created in chamber space 95 during a leak test, element 102 will tend toward sealing against the concave face of lip 101 in the manner suggested by FIG. 8, although it is to be appreciated that FIG. 8 shows a non-regulating position because movable wall 92 is being stopped by stop plane 109. Surface-to-surface sealing contact of element 102 around the full circumference of lip 101 provides a leak-proof seal between chamber spaces 93 and 95 with the sealed relationship of element 102 with lip 101 effectively preventing any flow through through-hole 100. The surface-to-surface sealing contact between concave face of lip 101 and region 105B of element 102 possesses a certain degree of tolerance to certain contaminants that may intrude into the interior of LDM 22. For example, the combination of thin compliant material forming region 105B of element 102 and sufficient radial width of lip 101 allows leak-proof sealing contact to occur, even in the presence of certain tiny particulate material between them, as sealing contact is occurring. Where a zone of the compliant material of element 102 encounters such particulate material, it tends to wrap around that particulate material while a contiguous zone of the compliant seal material makes surface-to-surface contact with lip 101. It may be further observed that no sealing of element 102 to post 99 is required. All that is needed is to be sure that element 102 is adequately retained on the post. The thickened region 105A is believed to provide a damping mass that mitigates potential for vibration of face 103 that might be deemed objectionable (noisy, for example) while regulating. When face 103 unseals from lip 101, air can flow through through-hole 100.

Disposed within the opening of main body 50 that is closed by sensor cap assembly 54 is a pressure sensor 110. This body opening provides a receptacle for the body of sensor 110 including an opening that communicates an atmospheric reference port of the sensor to passage 108. The sensor comprises a vacuum sensing port that is continuously communicated by a hose assembly 112 to chamber space 95. Sensor provides to EMC 16 a signal representing the pressure difference between its two sensing ports, hence a signal representing the magnitude of vacuum in chamber space 95 referenced to essentially atmosphere. Alternatively, the sensor may be a switch that switches at a certain pressure differential. Electric circuit connections from EMC 16 to sensor 110 and to solenoid assembly 60 are provided by a connector 114 disposed on the exterior of main body 50 and containing several electric terminals.

In module 24, nipple 52 passes through a top wall of the casing of canister 18 to communicate LDM 22 to the "clean air" side of vapor adsorbent medium within the canister casing. As shown by FIGS. 1 and 2, the "dirty air" side of the vapor adsorbent medium within canister 18 is in continuous communication with the evaporative emission space. Main body 50 comprises apertured tabs 116 that allow it to be fastened to the canister casing by fasteners (not shown).

Now that the construction of an exemplary embodiment of module 24 has been described in detail, a general explanation its operation is appropriate. When no leak test is being performed, PPS valve 20 is operated by EMC 16 to periodically purge vapors from canister 18 and the tank headspace to engine 12. The exact scheduling of such purging is controlled by the vehicle manufacturer's requirements. During non-test times, a non-restrictive vent path to atmosphere is open through module 24 so that the evaporative emission space is communicated to atmosphere, keeping the evaporative emission space generally at atmospheric pressure.

At the commencement of a leak test on EEC system 10, solenoid assembly 60 is operated closed, closing the atmospheric vent path through valve 88 of LDM 22. PPS valve 20 is operated open causing vacuum from intake manifold 28 of running engine 12 to be drawn in the evaporative emission space under test, including headspace of tank 14, canister 18, and any spaces, such as associated conduits, that are in communication therewith. Naturally all closures, such as the vehicle tank filler cap, must be in place to close the evaporative emission space under test except for the vacuum being drawn through PPS valve 20.

If no extraordinary conditions, such as a "pinched line" or a "gross leak" for example, are present, vacuum regulator valve 90 will become effective to regulate the vacuum in the evaporative emission space to the regulator valve's setting, and sensor 110 will detect when regulated vacuum has been attained. Once regulation commences, an appropriate amount of time is allowed for stability to be attained before the actual leak determination, or measurement, is undertaken.

Vacuum regulation occurs in the following manner. When the vacuum being drawn tends to exceed the set point of valve 90, movable wall 92 is displaced against the force of spring 98 to unseat lip 101 from face 103 of element 102 in a manner that allows sufficient air to bleed through through-hole 100 to prevent the vacuum in chamber space 95 from rising above the set point. In this way, valve 90 maintains the evaporative emission space vacuum just at the valve's set point. At the set point , air passes through nipple 86, filter element 84, passage 108, chamber space 93, and through-hole 100 into chamber space 95, and thence into the evaporative emission space under test, at a rate which maintains the vacuum at the set point even though manifold vacuum may be trying to increase the vacuum beyond that. It should be noted that vacuum regulator valve 90 is associated with the system in a manner that is non-intrusive on the purge strategy. This is a distinct advantage because it allows fuel vapor purging to continue according to programmed schedule during that portion of a leak detection test preceding the actual measurement. A typical vacuum setting, or set point, for regulator valve 90 is 8.0 inches $H_2O$, a vacuum considerably smaller than customary intake manifold vacuum.

The actual leak determination, or measurement, is allowed to proceed only after PPS valve 20 has been re-closed while valve 88 of LDM 22 remains closed. For assuring accuracy in the measuring process, regulator valve 90 must also remain closed during that process. For assuring that regulator valve 90 is in fact closed, valve 88 is momentarily opened and then re-closed after PPS valve 20 has been re-closed. This bleeds a small amount of vacuum from the evaporative emission space under test so that at the beginning of the actual measurement process, the vacuum in that space will be slightly less than the set point of valve 90, assuring that movable wall 92 is positioned by spring 98 such that lip 101 seals fluid-tight against element 102. Because all valves exposed to the space under test are now closed, and vacuum in that space cannot increase, the leak-proof closure of through-hole 100 is maintained. The pressure differential across the portion of face 103 spanning through-hole 100 aids in maintaining the seal. Because of assurance of integrity of the seal during the measurement phase, a potential source of error in the measurement, i.e. loss of vacuum through LDM 22 to atmosphere, is eliminated.

Leakage is determined by utilizing sensor 110 to indicate loss of vacuum as test time elapses. Steps of a specific leak detection test that is conducted in accordance with the foregoing general description are described in U.S. Pat. No. 6,016,690.

While a presently preferred embodiment of the invention has been illustrated and described, it should be appreciated that principles are applicable to other embodiments that fall within the scope of the following claims. For example, vacuum regulator valve 90 and vent valve 88 could be a separate assemblies, rather than being integrated into LDM 22.

What is claimed is:

1. An automotive vehicle comprising:

a fuel-consuming internal combustion engine that powers the vehicle and comprises an intake manifold;

a fuel storage system for storing volatile liquid fuel for consumption by the engine and comprising an evaporative emission space for containing fuel vapor;

an evaporative emission control system comprising a vent valve for selectively opening and closing a vent path from the evaporative emission space to atmosphere, a fuel vapor collection medium disposed in the vent path for trapping fuel vapors so their escape to atmosphere through the vent path is prevented, and a purge valve for selectively opening and closing a vapor purge path from the evaporative emission space to the intake manifold to selectively purge fuel vapors from the evaporative emission space and medium to the engine; and a vacuum regulator valve for regulating vacuum in the evaporative emission space to a defined magnitude when the vent valve is closed, the purge valve is open, and the engine is running;

wherein the vacuum regulator valve comprises a movable wall dividing a housing into a first chamber space communicated to atmosphere and a second chamber space communicated to the evaporative emission space, a spring resiliently biasing the movable wall in a sense toward decreasing the volume of the first chamber space while increasing the volume of the second chamber space, a through-hole in the movable wall via which the two chamber spaces can communicate, and a compliant, impermeable seal element toward which the movable wall is resiliently biased, the seal element comprising a face disposed to confront the movable wall for selectively sealing against the movable wall around the margin of the through-hole to close the through-hole and unsealing from the margin of the through-hole to open the through-hole.

2. An automotive vehicle as set forth in claim 1 in which the vent valve and the vacuum regulator valve are disposed in parallel flow relation between the medium and atmosphere.

3. An automotive vehicle as set forth in claim 2 in which the first chamber space and the vent valve are communicated to atmosphere through a particulate filter.

4. An automotive vehicle as set forth in claim 1 in which the movable wall comprises a centrally disposed, rigid insert containing the through-hole.

5. An automotive vehicle as set forth in claim 4 in which the margin of the through-hole toward the seal element comprises a lip surrounding the through-hole and having a sealing surface against which the seal element selectively seals and unseals.

6. An automotive vehicle as set forth in claim 5 in which the sealing surface of the lip, as viewed in radial cross section relative to a center line of the through-hole, is concave.

7. An automotive vehicle as set forth in claim 6 in which the seal element is disposed on, and in covering relation to an end of, a post comprising a rim circumscribing the end of the post, and the face of the seal element spans the rim.

8. An automotive vehicle as set forth in claim 7 in which the rim comprises a rounded crown on which the face of the seal element is supported in spaced relation to that portion of the end of the post circumscribed by the rim.

9. An automotive vehicle as set forth in claim 8 in which the seal element wraps around the rounded crown and along a side of the post.

10. An automotive vehicle as set forth in claim 9 in which the seal element comprises a bead lodging in an annular groove in the side of the post.

11. An automotive vehicle as set forth in claim 8 in which thickness of a central zone of the face of the seal element circumscribed by the rim is greater than thickness of a surrounding zone of the seal element face that makes sealing contact with the sealing surface of the lip.

12. An automotive vehicle as set forth in claim 7 including a stop for limiting displacement of the insert toward the post such that when the insert is maximally displaced toward the post, the insert is spaced from the post.

13. An on-board evaporative emission leak detection system for detecting leakage from evaporative emission space of a fuel storage system for storing volatile liquid fuel for consumption by an engine of an automotive vehicle, the leak detection system comprising:

two parallel flow branches between the evaporative emission space and atmosphere;

one branch comprising a selectively operable vent valve for opening and closing the one branch; and the other branch comprising a regulator valve for regulating pressure differential between atmosphere and the evaporative emission space to a defined differential when the vent valve is closed and the differential attempts to increase beyond the defined differential;

wherein the regulator valve comprises a movable wall dividing a housing into two chamber spaces, a first of which is communicated to atmosphere and a second of which is communicated to the evaporative emission space, a spring resiliently biasing the movable wall in a sense toward decreasing the volume of one chamber space while increasing the volume of the other chamber space, a through-hole in the movable wall via which the two chamber spaces can communicate, and a compliant, impermeable seal element toward which the spring resiliently biases the movable wall, the seal element comprising a face disposed to confront the movable wall for selectively sealing against the movable wall around the margin of the through-hole to close the through-hole and unsealing from the margin of the through-hole to open the through-hole.

14. A leak detection system as set forth in claim 13 in which the regulator valve comprises a vacuum regulator for regulating vacuum in the evaporative emission space to a defined vacuum in the evaporative emission space when the vent valve is closed and vacuum in the evaporative emission space attempts to increase beyond the defined vacuum.

15. A leak detection system as set forth in claim 13 in which the movable wall comprises a centrally disposed, rigid insert containing the through-hole, the margin of the through-hole toward the seal element comprises a lip surrounding the through-hole, and the lip has a sealing surface against which the seal element selectively seals and unseals.

16. A leak detection system as set forth in claim 15 in which the sealing surface of the lip, as viewed in radial cross section relative to a center line of the through-hole, is concave.

17. A leak detection system as set forth in claim 13 in which the movable wall comprises a centrally disposed, rigid insert containing the through-hole, the seal element is disposed on, and in covering relation to an end of, a post comprising a rim circumscribing the end of the post, and the face of the seal element spans the rim.

18. A leak detection system as set forth in claim 17 in which the rim comprises a rounded crown on which the face of the seal element is supported in spaced relation to that portion of the end of the post circumscribed by the rim, and the seal element wraps around the rounded crown, extends along a side of the post, and terminates in a bead lodging in an annular groove in the side of the post.

19. A leak detection system as set forth in claim 17 in which thickness of a central zone of the face of the seal element circumscribed by the rim is greater than thickness of a surrounding zone of the seal element face that makes sealing contact with the sealing surface of the lip.

20. A leak detection system as set forth in claim 17 including a stop limiting displacement of the insert toward the post such that when the insert is maximally displaced toward the post, the insert is spaced from the post.

21. A module for an on-board evaporative emission leak detection system for detecting leakage from an evaporative emission space of a fuel storage system that stores volatile liquid fuel for consumption by an engine of an automotive vehicle, the module comprising:

a housing having a first port adapted to be placed in communication with the evaporative emission space and a second port adapted to be communicated to atmosphere;

two parallel flow branches between the first and second ports;

one branch comprising a selectively operable vent valve for opening and closing the one branch; and the other branch comprising a regulator valve for regulating pressure differential between the first and second ports to a defined differential when the vent valve is closed and the differential attempts to increase beyond the defined differential;

wherein the regulator valve comprises a movable wall dividing the housing into two chamber spaces, a first of which is communicated to atmosphere and a second of which is communicated to the evaporative emission space, a spring resiliently biasing the movable wall in a sense toward decreasing the volume of one chamber space while increasing the volume of the other chamber space, a through-hole in the movable wall via which the two chamber spaces can communicate, and a compliant, impermeable seal element toward which the spring resiliently biases the movable wall, the seal element comprising a face disposed to confront the movable wall for selectively sealing against the movable wall around the margin of the through-hole to close the through-hole and unsealing from the margin of the through-hole to open the through-hole.

22. A leak detection system as set forth in claim 21 in which the regulator valve comprises a vacuum regulator for regulating vacuum in the evaporative emission space to a defined vacuum in the evaporative emission space when the vent valve is closed and vacuum in the evaporative emission space attempts to increase beyond the defined vacuum.

23. A leak detection system as set forth in claim 21 in which the movable wall comprises a centrally disposed, rigid insert containing the through-hole, the margin of the through-hole toward the seal element comprises a lip surrounding the through-hole, and the lip has a sealing surface against which the seal element selectively seals and unseals.

24. A leak detection system as set forth in claim 23 in which the sealing surface of the lip, as viewed in radial cross section relative to a center line of the through-hole, is concave.

25. A leak detection system as set forth in claim 21 in which the movable wall comprises a centrally disposed, rigid insert containing the through-hole, the seal element is disposed on, and in covering relation to an end of, a post comprising a rim circumscribing the end of the post, and the face of the seal element spans the rim.

26. A leak detection system as set forth in claim 25 in which the rim comprises a rounded crown on which the face of the seal element is supported in spaced relation to that portion of the end of the post circumscribed by the rim, and the seal element wraps around the rounded crown, extends along a side of the post, and terminates in a bead lodging in an annular groove in the side of the post.

27. A leak detection system as set forth in claim 25 in which thickness of a central zone of the face of the seal element circumscribed by the rim is greater than thickness of a surrounding zone of the seal element face that makes sealing contact with the sealing surface of the lip.

28. A leak detection system as set forth in claim 25 including a stop limiting displacement of the insert toward the post such that when the insert is maximally displaced toward the post, the insert is spaced from the post.

29. A regulator valve comprising a movable wall dividing a housing into two chamber spaces, a first of which is adapted to be communicated to a reference pressure and a second of which is adapted to be communicated to pressure to be regulated, a spring resiliently biasing the movable wall in a sense toward decreasing the volume of one chamber space while increasing the volume of the other chamber space, a through-hole in the movable wall via which the two chamber spaces can communicate, and a compliant, impermeable seal element toward which the spring resiliently biases the movable wall, the seal element comprising a face disposed to confront the movable wall for selectively sealing against the movable wall around the margin of the through-hole to close the through-hole and unsealing from the margin of the through-hole to open the through-hole.

30. A regulator valve as set forth in claim 29 in which the regulator valve comprises a vacuum regulator for regulating vacuum in the second chamber space to a defined vacuum when vacuum in the second chamber space tends to increase beyond the defined vacuum.

31. A regulator valve as set forth in claim 29 in which the movable wall comprises a centrally disposed, rigid insert containing the through-hole, the margin of the through-hole toward the seal element comprises a lip surrounding the through-hole, and the lip has a sealing surface against which the seal element selectively seals and unseals.

32. A regulator valve as set forth in claim 31 in which the sealing surface of the lip, as viewed in radial cross section relative to a center line of the through-hole, is concave.

33. A regulator valve as set forth in claim 29 in which the movable wall comprises a centrally disposed, rigid insert containing the through-hole, the seal element is disposed on, and in covering relation to an end of, a post comprising a rim circumscribing the end of the post, and the face of the seal element spans the rim.

34. A regulator valve as set forth in claim 33 in which the rim comprises a rounded crown on which the face of the seal element is supported in spaced relation to that portion of the end of the post circumscribed by the rim, and the seal element wraps around the rounded crown, extends along a side of the post, and terminates in a bead lodging in an annular groove in the side of the post.

35. A regulator valve as set forth in claim 33 in which thickness of a central zone of the face of the seal element circumscribed by the rim is greater than thickness of a surrounding zone of the seal element face that makes sealing contact with the sealing surface of the lip.

36. A regulator valve as set forth in claim 33 including a stop limiting displacement of the insert toward the post such that when the insert is maximally displaced toward the post, the insert is spaced from the post.

* * * * *